United States Patent [19]

Heeb

[11] 4,295,447

[45] Oct. 20, 1981

[54] HEATING BOILER AND TEMPERATURE CONTROL THEREFOR

[75] Inventor: Adolf Heeb, Vaduz, Liechtenstein

[73] Assignee: Interliz Anstalt, Vaduz-Neugut, Liechtenstein

[21] Appl. No.: 72,755

[22] Filed: Sep. 5, 1979

[30] Foreign Application Priority Data

Sep. 23, 1978 [DE] Fed. Rep. of Germany ..... 2841476

[51] Int. Cl.[3] ..... F22B 7/00

[52] U.S. Cl. ..... 122/136 R; 122/17; 126/361

[58] Field of Search ..... 122/2, 13 R, 17, 136 R, 122/136 C, 149, 155 R, 155 C, 155 F, 189; 126/361

[56] References Cited

U.S. PATENT DOCUMENTS

| | | | |
|---|---|---|---|
| 2,652,036 | 9/1953 | Grace | 122/136 C |
| 2,814,278 | 11/1957 | Cameron | 122/17 |
| 3,236,212 | 2/1966 | Ospelt | 122/136 R |
| 3,465,123 | 9/1969 | Harris | 126/361 |
| 3,612,001 | 10/1971 | Gossalter | 122/136 R |
| 3,707,142 | 12/1972 | Kobayashi | 122/17 |
| 3,718,544 | 2/1973 | Sims | 122/17 |
| 3,802,397 | 4/1974 | Wariner | 122/136 R |
| 4,206,723 | 6/1980 | Kunkel | 122/2 |

*Primary Examiner*—Henry C. Yuen
*Attorney, Agent, or Firm*—Jordan and Hamburg

[57] ABSTRACT

A heating boiler has a substantially horizontally extending combustion chamber for combustion of liquid or gaseous fuel, a boiler water chamber surrounding the combustion chamber, a thermostat probe having a sensor section extending into said boiler water chamber, an auxiliary heating channel positioned within the boiler water chamber, a return pipe extending into the boiler water chamber for the discharge of return water thereinto, an outflow chamber surmounting one end of the combustion chamber and separated from the boiler water chamber by a separator wall, the outflow chamber being in communication with one end of the combustion chamber and the inlet of the auxiliary heating channel communicating with one end of the combustion chamber through the separator wall and the outflow chamber, the sensor section of the thermostat probe being disposed above the auxiliary heating channel adjacent thereto and proximate the inlet thereof, and the discharge end of the return pipe being located within the boiler water chamber such that the sensor section of the thermostat probe is washed by the discharged return water.

2 Claims, 2 Drawing Figures

HEATING BOILER AND TEMPERATURE CONTROL THEREFOR

BACKGROUND OF THE INVENTION

The invention relates to a heating boiler with a substantially horizontal burner chamber provided with a burner for combustion of liquid or gaseous fuel. A boiler water space surrounds the burner chamber and a boiler return connection passes into the boiler water space. A thermostat probe projects into the boiler water space and an auxiliary heating channel extends in the longitudinal direction of the burner chamber, the auxiliary heating channel being disposed in the boiler water space above the burner chamber. The inlet end of the auxiliary heating channel opens into an outflow chamber which is delimited by a boiler separator wall, the outflow chamber thus serving as a connection between the exhaust outlet of the burner chamber and the auxiliary heating channel.

A conventional embodiment of such a heating boiler has a cylindrical burner chamber with a closed rear end and a front end connected to the outflow chamber. The burner chamber is disposed within the lower region of a narrow oval outer boiler body. Recently it was found advantageous to employ a space-saving box-shaped oblong hollow body as the auxiliary heating channel in the upper region of the outer boiler body instead of a plurality of pipes which require many weld connections inter alia to the boiler separator wall. In order to promote heat transfer, the hollow body is provided with, for instance, comb-like inner ribs which are intensely heated by flue gases streaming from the burner chamber through the outflow chamber into the hollow body. The heat is transferred to the walls of the hollow body which in turn transfers the heat to the boiler water. Heating boilers of this or similar construction have a boiler water space containing comparatively little water due to their compact construction and the small, space-saving boiler dimensions. This has led to the following problem due to the small amount of boiler water used.

The regulation of the temperature of the boiler water is controlled by a regulating thermostat which is set at the desired discharge temperature of the boiler water in the discharge pipe connection which usually leads into a mixer valve. The regulating thermostat turns off the burner once the desired temperature is reached and is aided by a limiter thermostat that is set at a higher temperature, usually at a temperature of 90° to 95° C. In most cases the heating boiler is also furnished with a hot water system which can be heated by the boiler water to produce hot service water. When the water in such system demands heat, be it when actuating the heating boiler to supply hot water for the heating unit or installation or be it in summmer when the heating boiler works only for the heating of the water in the hot water system, the regulating thermostat is overrun so that the temperature of the boiler water may rise up to the set temperature of the limiter thermostat in order to accelerate the heating of the water in the hot water system.

Safety precautions have demand recently that a safety limiter be provided when a limiter thermostat is used for the burner regulation. The safety limiter responds at a maximum temperature of 100° C. and locks mechanically after turning off the burner so that the burner stays switched off until the safety limiter is manually opened. With heating boilers of relatively small boiler water content, it sometimes occurs that the temperature of the heating boiler rises so fast that its water obtains a substantially higher temperature than set on the thermostat. This happens in summer when the heating boiler is only needed to furnish the hot water system with hot boiler water, or also when the heating boiler is used in a transitional season when very little boiler water is discharged through the barely opened mixer valve into the heating unit and is flowing back into the heating boiler as cooled return-flow water. An after heating effect is caused by the large time lag of the conventional thermostats and considerable amounts of heat are stored in the indirect boiler heating surfaces which are transferred to the boiler water after the burner is turned off. The temperature of the boiler water is thus increased.

As a consequence of the aforementioned cases of boiler use where the burner regulation for the heating of the hot water system is controlled by the limiter thermostat, operating troubles occur again and again because the further rise in boiler water temperature after the turning off of the burner leads to an exceeding of the activation temperature of the safety limiter so that it must frequently be manually released.

In order to prevent these operating difficulties, users set the limiter thermostat as well as the regulation thermostat lower by at least the temperature increase attributable to the after heating effect, which may amount to 8° C., for instance at 82° to 85°, in order to assure that the safety limiter will not react due to the after heating effect, after the turning off of the burner at least when the temperature of the boiler water has risen only to the temperature at which the limiter thermostat was set. This, however, results in the disadvantage that, when the heating unit needs much heat and the mixer valve opens completely and the whole amount of the water circuit of the heating unit passes through the heating boiler, a lower boiler water discharge temperature is obtained in the boiler discharge pipe, a temperature which at most only corresponds to the lowered set value of the limiter thermostat. This disadvantage remains also when the regulation thermostat is set at a higher temperature, because even at normal regulation of the burner by the regulation thermostat, the limiter thermostat remains active and turns the burner off as soon as the water temperature of the boiler water reaches the 82° to 85° set by the limiter thermostat. Due to the fact that most heating plants are set for outside temperatures of −15° C. (5° F.) and a maximum discharge temperature of 90° C. (194° F.) a lower setting of the limiter thermostat leads practically to the disadvantage of too low hot water temperature on very cold winter days. This problem of overshooting the temperature due to the post or after heating of the boiler water could be remedied by the use of substantially faster reacting and more sensitive thermostats with smaller shifting differentials. On one hand such thermostats are not to be found in the trade, and furthermore, such thermostats if used would substantially increase the frequency of switching intervals (switching on and off of the burner) which definitely would impair the efficiency of the burner-heating boiler system and would also cause impure flue gases, thus preventing their acceptance in many countries because of the impairment in air quality.

SUMMARY OF THE INVENTION

The boiler control system of the invention allows the functioning of a heating boiler with great starting speed in summer as well as the functioning of the heating boiler system in intermediate seasons and also the functioning in winter time when a complete circulation of the water mass through the heating boiler makes a discharge temperature of 90° C. (194° F.) possible.

According to the present invention there is provided a heating boiler having a substantially horizontally extending combustion chamber for combustion of liquid or gaseous fuel, a boiler water chamber surrounding the combustion chamber, a thermostat probe having a sensor section extending into the boiler water chamber, an auxiliary heating channel positioned within the boiler water chamber to extend longitudinally of the combustion chamber, a return pipe extending into the boiler water chamber for the discharge of return water thereinto, an outflow chamber surmounting one end of the combustion chamber and separated from the boiler water chamber by a separator wall, the outflow chamber being in communication with one end of the combustion chamber and the inlet of the auxiliary heating channel communicating with one end of the combustion chamber through the separator wall and the outflow chamber, the sensor section of the thermostat probe being disposed above the auxiliary heating channel adjacent thereto and proximate the inlet thereof, and the discharge end of the return pipe being disposed in the boiler water chamber such that the sensor section of the thermostat probe is washed by the discharge return water.

DESCRIPTION OF THE PREFERRED EMBODIMENTS

Figure 2:
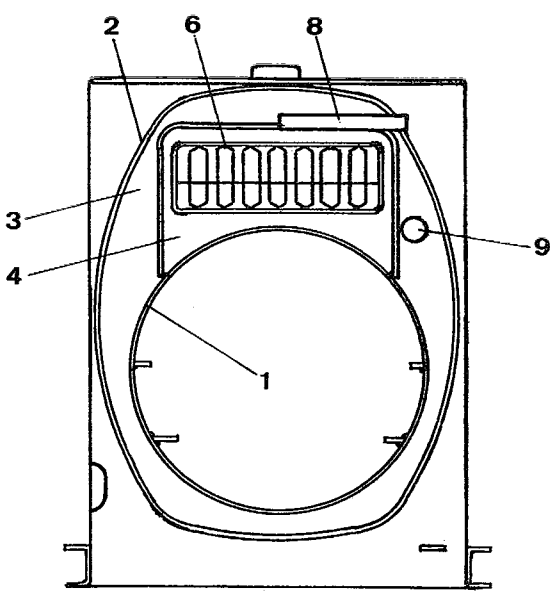
FIG. 2 is a schematic cross sectional view of the heating boiler shown in FIG. 1 taken along line II—II in FIG. 1.
Figure 1:
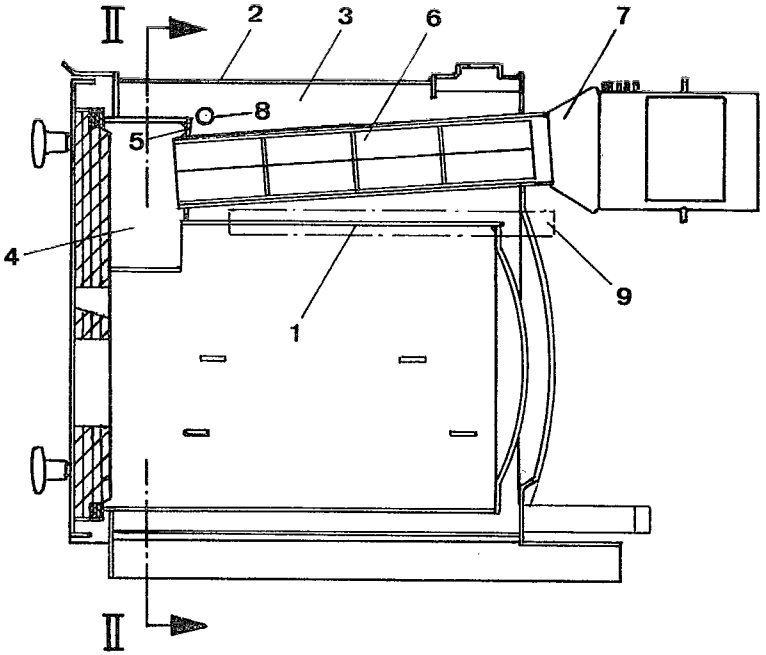
FIG. 1 is a schematic side elevational view, in cross section, of a heating boiler embodying the invention.

The heating boiler shown in the drawings includes a substantially horizontal cylindrical combustion chamber 1, its rear end being closed, and the front end of which is open to receive a burner for combustion of a fluid or gaseous fuel. The combustion chamber 1 is disposed within the lower region of an oval exterior boiler body 2 so as to define a boiler water space or chamber 3 therebetween. The exhaust outlet of the combustion chamber 1 is connected to an outflow chamber 4, which together with the front end of the combustion chamber 1, is closed by a common combustion chamber door, the door being tightly sealed against the outside. The outflow chamber 4 is provided with a vertical boiler separation wall 5 which serves to separate the outflow chamber from the boiler water chamber 3.

An auxiliary heating channel 6 extends in the longitudinal direction of the combustion chamber 1 and consits of a box-shaped hollow body with inner ribs. The auxiliary heating channel 6 is disposed in the boiler water chamber above the combustion chamber 1. The front entrance end of the auxiliary heating channel 6 communicates through the boiler separator wall 5 with the outflow chamber 4 and is thus connected by it with the flue exhaust outlet of the combustion chamber 1. A flue gas collector 7 for the heating boiler is connected to the rear or discharge end of the auxiliary heating channel 6.

A thermostat probe 8 projects into the boiler water chamber 3. The probe 8 may consist of individual probes or of combined probes for a regulation thermostat, a limiter thermostat and a safety limiter furnished with a mechanical locking device. Thermostat probe 8 is disposed above the auxiliary heating channel 6 close to its upper side at a distance as small as possible such as 2 to 3 mm. Because auxiliary heating channel 6 is primarily heated at its entrance end by the flow of combustion gases, the thermostat probe 8 is also disposed near the boiler separation wall 5 at the entrance end of the auxiliary heating channel 6. Due to such construction the thermostat probe 8 is disposed within the boundary layer of the boiler water which exchanges heat with the auxiliary heating channel 6 where a significant quantity of heat develops and where a higher water temperature results than elsewhere in the boiler water chamber when the burner is in its operative mode. Therefore the limiter thermostat, which is connected to the thermostat probe and for example, is set at 90° C., and which regulates the burner during the heating of a hot water system to be heated by the heating boiler, turns the boiler off when the effective boiler temperature is about 82° C. The heat, retained mainly in the inner ribs of the auxiliary heating channel 6, effects post-heating of the boiler water after the burner is turned off and until a boiler water temperature of 90° is attained so that under no circumstances will the safety limiter, connected to the thermostat probe, be activated and automatically locked.

A boiler return pipe 9 extends into the boiler water chamber 3 and projects therethrough in such a manner that its discharge aperture is proximate the thermostat probe 8 so that thermostat probe is washed by the return water discharged into the boiler water chamber 3. This construction allows physical contact between the return water and the thermostat probe at a distance as short as possible from the return pipe 9. Due to such construction where the heating boiler is forcefully traversed by boiler water during the winter months, the thermostat probe is cooled down by the return water so that the regulation thermostat, connected to the thermostat probe and in winter time set at 90° C., does not turn off the burner at a boiler temperature of 90° C. Thus the temperature of 90° is obtained in the boiler discharge pipe as desired by the setting of the regulation thermostat.

From the foregoing it will be seen that the boiler controls of the invention include positioning of the thermostat probe in the boiler water chamber above the auxiliary heating channel close to the upper side thereof and also close to the boiler separator wall at the inlet end of the auxiliary heating channel. The boiler return pipe extends into the boiler water chamber to the vicinity of the thermostat probe, such that the thermostat probe is directly washed by the return water discharged into the boiler water chamber by the boiler return pipe.

The results of the described arrangement is that when during the heating of the hot water system no return water (in summer) or very little water (in the transitional season) runs through the return pipe into the heating boiler, at the thermostat probe (one or several probes for the regulation thermostat, limiter thermostat and safety thermostat) there is simulated a 6 degree to 8 degree higher temperature due to the arrangement of the probe at a very small distance from the upper side of the auxiliary heating channel and from the boiler separator wall at the inlet end of the auxiliary heating channel. Under these circumstances the probe is subjected to the higher temperature because a very strong heat effect obtains here as long as the burner runs. Therefore, the limiter thermostat, which regulates the burner during the heating of the hot water system, turns the burner off at about 82° C. (179° F.) effective boiler temperature, even though it is set at 90° C. (194° F.).

The post-heating caused mainly by the accumulation of heat in the ribs of the auxiliary heating channel results in a rise in boiler water temperature in all the upper parts of the heating boiler to a temperature of 90° C. (194° F.) which is desirable for the acceleration of the heating of the hot water system. But post-heating does not proceed any further, thus ensuring a boiler water temperature below the set value of the safety limiter and thereby preventing activation of the safety limiter.

During winter, when cooled return water flows through the return pipe into the heating boiler, the thermostat probe is directly washed by the flowing return water, and is thereby cooled because the return pipe with its discharge aperture protrudes into the boiler space close to the position of the thermostat probe. Now, naturally, all heating cycles of the heating boiler run considerably slower because the heating boiler is energetically perfused, and all thermostats react normally. Therefore, a correct discharge temperature can be obtained at 90° C. (b 194° F.) easily when the regulation thermostat is correspondingly set and without premature activation of the limiter thermostat which would turn off the burner too soon and also without activation of the safety limiter.

The action of the heating boiler according to the invention is based upon the fact that in summer such a high temperature prevails at the location where the thermostat probe is disposed that it corresponds practically to the final temperature obtained in th boiler water mantle by the post-heating. On the other hand, during winter the thermostat probe is in the region of the discharged return water that washes it so strongly to cool the probe such that the temperature prevailing around it is practically the same temperature as the discharged boiler water.

It is thought that the invention and many of its attendant advantages will be understood from the foregoing description and that it will be apparent that various changes may be made in the form, construction, and arrangements of the parts without departing from the spirit and scope of the invention or sacrificing all of its material advantages. The form heretofore described being merely a preferred embodiment thereof.

What is claimed is:

1. In a heating boiler having a substantially horizontally extending combustion chamber for combustion of liquid or gaseous fuel, said combustion chamber having a cylindrical cross sectional configuration and having a front end and a closed rear end, said combustion chamber having at said front end thereof a flue exhaust outlet, a boiler water chamber surrounding said combustion chamber, said boiler water chamber being defined by a boiler body of oval-shaped cross sectional configuration, said combustion chamber being disposed within the lower region of said boiler body, a thermostat probe having a sensor section extending into said boiler water chamber, an auxiliary heating channel positioned above said combustion chamber within the boiler water chamber to extend longitudinally of the combustion chamber, said auxiliary heating channel comprising a box-shaped hollow body disposed within the upper region of said boiler body, a return pipe extending into the boiler water chamber for fthe discharge of return water thereinto, an outflow chamber surmounting said flue exhaust outlet, said outflow chamber comprising a separator wall which separates said outflow chamber from said boiler water chamber, said outflow chamber being in communication with said flue exhaust outlet, said auxiliary heating channel having an inlet joined to said separator wall such that said inlet of said auxiliary heating channel communicates through said separator wall with said outflow chamber and via the outflow chamber with said flue exhaust outlet at the front end of said combustion chamber, said box-shaped hollow body having an upper horizontal side and at least one vertical side, said thermostat probe extending through said boiler body and transversely of said auxiliary heating channel into said boiler water chamber to terminate in said sensor section above said upper horizontal side of said auxiliary heating channel and adjacent to said separator wall, said return pipe extending within said boiler water chamber from the rear end of said boiler body and along side said vertical side wall of said auxiliary heating channel, the discharge end of said return pipe being disposed below said thermostat probe, said sensor section of the thermostat probe being disposed above said inlet of said auxiliary heating channel and adjacent to said separator wall, the discharge end of the return pipe being located within said boiler water chamber in the vicinity of said sensor section such that said sensor section of the thermostat probe is directly washed by the discharged return water.

2. A heating boiler according to claim 1, wherein said sensor section is positioned approximately 2 to 3 mm from said upper horizontal side of said auxiliary heating channel and 2 to 3 mm from said separator wall.

* * * * *